US009352860B2

(12) United States Patent
Vollenkemper et al.

(10) Patent No.: US 9,352,860 B2
(45) Date of Patent: May 31, 2016

(54) ROTATABLE PACKAGING MACHINE, AND METHOD FOR FILLING OPEN BAGS

(75) Inventors: Willi Vollenkemper, Oelde (DE); Frank Waltermann, Ahlen (DE)

(73) Assignee: HAVER & BOECKER OHG, Oelde (DE)

( * ) Notice: Subject to any disclaimer, the term of this patent is extended or adjusted under 35 U.S.C. 154(b) by 156 days.

(21) Appl. No.: 14/116,524

(22) PCT Filed: May 2, 2012

(86) PCT No.: PCT/EP2012/001874

§ 371 (c)(1),
(2), (4) Date: Dec. 11, 2013

(87) PCT Pub. No.: WO2012/152402

PCT Pub. Date: Nov. 15, 2012

(65) Prior Publication Data

US 2014/0083560 A1 Mar. 27, 2014

(30) Foreign Application Priority Data

May 9, 2011 (DE) ..... 10 2011 101 047

(51) Int. Cl.

| | |
|---|---|
| ***B65B 1/04*** | (2006.01) |
| ***B65B 3/00*** | (2006.01) |
| ***B65B 43/46*** | (2006.01) |
| ***B65B 43/60*** | (2006.01) |
| ***B65B 1/22*** | (2006.01) |

(52) U.S. Cl.

CPC ... *B65B 3/00* (2013.01); *B65B 1/04* (2013.01); *B65B 1/22* (2013.01); *B65B 43/465* (2013.01); *B65B 43/60* (2013.01)

(58) Field of Classification Search

CPC ..... B65B 1/04; B65B 1/06; B65B 1/20; B65B 43/46; B65B 43/465; B65B 43/58; B65B 43/59; B65B 43/60

USPC ..... 141/10, 114, 313–317

See application file for complete search history.

(56) References Cited

U.S. PATENT DOCUMENTS

| | | | | |
|---|---|---|---|---|
| 2,833,097 | A * | 5/1958 | Petrea et al. | 53/571 |
| 3,748,823 | A * | 7/1973 | Mayer | 53/570 |
| 3,961,461 | A | 6/1976 | Ruf et al. | |
| 4,019,546 | A * | 4/1977 | Hastrup | 141/10 |
| 4,045,940 | A * | 9/1977 | White et al. | 53/447 |

(Continued)

FOREIGN PATENT DOCUMENTS

| | | |
|---|---|---|
| DE | 3416155 | 1/1985 |
| DE | 4439655 | 5/1995 |

(Continued)

*Primary Examiner* — Nicolas A Arnett

(74) *Attorney, Agent, or Firm* — Pearne & Gordon LLP

(57) ABSTRACT

Rotary packaging machine and method for filling open-mouth bags with multiple filling units disposed over the circumference and rotating along, each of which having a filling spout with a filling opening to which the open-mouth bags can be appended by way of a motion oriented upwardly relative to the filling spout. A handling unit configured as a take-over device is provided for taking over the filled open-mouth bags from the filling units and comprises a gripping arm with a gripping unit provided thereat. The gripping arm is rotatingly disposed at the take-over device. The gripping unit is pivotally disposed at the gripping arm for performing relative to the gripping arm a pivoting motion superimposed on the gripping arm rotation.

13 Claims, 5 Drawing Sheets

(56) References Cited

U.S. PATENT DOCUMENTS

Figure 1:
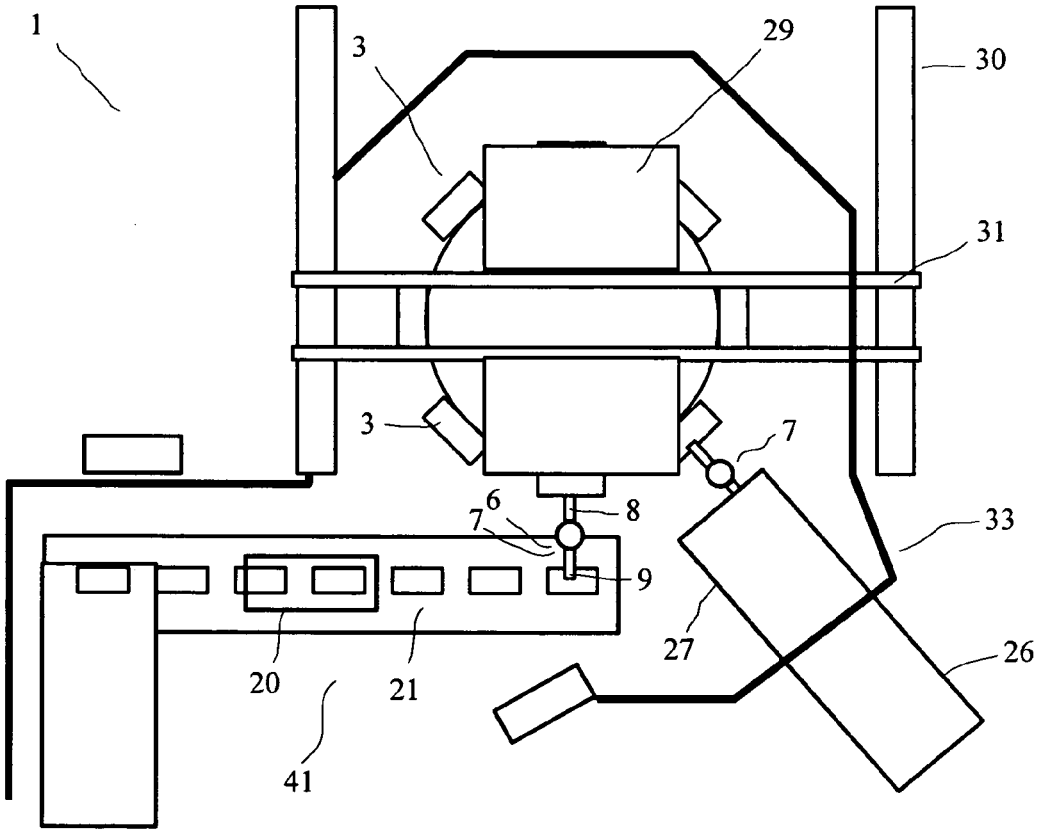

| | | | | |
|---|---|---|---|---|
| 5,457,930 | A * | 10/1995 | Dauder-Guardiola | 53/138.3 |
| 7,162,852 | B2 | 1/2007 | Eder | |
| 7,856,792 | B2 * | 12/2010 | Koga et al. | 53/53 |
| 7,954,307 | B2 | 6/2011 | Paunesku et al. | |
| 8,245,485 | B2 * | 8/2012 | Fukeda et al. | 53/95 |
| 8,282,538 | B2 | 10/2012 | Paunesku et al. | |
| 8,943,783 | B2 * | 2/2015 | Ouellet et al. | 53/469 |
| 2005/0229550 | A1 | 10/2005 | Eder | |
| 2007/0074492 | A1 * | 4/2007 | Koga et al. | 53/512 |
| 2007/0089377 | A1 * | 4/2007 | Yasuhira | 53/403 |
| 2007/0180794 | A1 | 8/2007 | Paunesku et al. | |
| 2007/0204570 | A1 * | 9/2007 | Okazaki | 53/459 |
| 2008/0072547 | A1 * | 3/2008 | Murray | 53/451 |
| 2009/0233778 | A1 * | 9/2009 | Tsutsui et al. | 493/212 |
| 2010/0018160 | A1 * | 1/2010 | Fukeda et al. | 53/407 |
| 2011/0224061 | A1 | 9/2011 | Paunesku et al. | |
| 2012/0240531 | A1 * | 9/2012 | Kawamura et al. | 53/572 |
| 2012/0325063 | A1 | 12/2012 | Paunesku et al. | |
| 2013/0125508 | A1 * | 5/2013 | Honda | 53/268 |
| 2013/0160400 | A1 * | 6/2013 | Decio | 53/284.7 |
| 2013/0192720 | A1 * | 8/2013 | Ouellet et al. | 144/24.17 |
| 2014/0083559 | A1 * | 3/2014 | Korte et al. | 141/10 |
| 2014/0250834 | A1 * | 9/2014 | Yoshikane et al. | 53/403 |
| 2014/0283483 | A1 * | 9/2014 | Yoshikane et al. | 53/403 |
| 2014/0325938 | A1 * | 11/2014 | Yoshikane et al. | 53/79 |
| 2014/0331603 | A1 * | 11/2014 | Takahashi | 53/408 |
| 2014/0352253 | A1 * | 12/2014 | Yamamoto et al. | 53/76 |

FOREIGN PATENT DOCUMENTS

| | | |
|---|---|---|
| DE | 10235929 | 3/2004 |
| DE | 102008020254 | 10/2009 |
| EP | 0576058 | 12/1993 |
| JP | 6199317 | 7/1994 |
| WO | 2007089838 | 8/2007 |

* cited by examiner

ROTATABLE PACKAGING MACHINE, AND METHOD FOR FILLING OPEN BAGS

The present invention relates to a rotary packaging machine and a method for filling open-mouth bags. The packaging machine according to the invention may be intended for bagging all kinds of bulk goods. This kind of system is particularly preferably used for bagging fine-grain products, i.e. for bagging fine and dusty products requiring extended filling and in particular compacting times.

A great variety of packaging machines for filling open-mouth bags have been disclosed in the prior art. For example so-called FFS packaging machines ("Form-Fill-Seal packaging machines") tend to be used for efficiently filling bulk materials into open-mouth bags. In these FFS packaging systems the open-mouth bag is manufactured within the machine or in an immediately preceding device. The machine has a roll of tubular sheet assigned to it from which the required open-mouth bags are continuously manufactured during operation. A considerable advantage of these FFS packaging machines consists in that the open-mouth bags can be manufactured in the actually required lengths. There is no need to employ preformed bags which are also more expensive.

FFS packaging machines process open-mouth bags of plastic sheet which is waterproof. This is why open-mouth bags filled with hygroscopic materials—such as cement—are suitable for open-air storage after closing since their contents are reliably protected against moisture.

The drawback of known packaging machines for filling open-mouth bags is their limited capacity in particular when bagging dusty, fine-grain products since these products must as a rule be compacted to provide a firm package in which the smallest possible amount of air is contained. Entrapped air moreover reduces the stacking capability.

For increasing throughput, packaging machines for filling open-mouth bags have been disclosed which are rotary in construction and comprise multiple filling spouts distributed over the circumference to which open-mouth bags are appended for filling. To ensure reliable appending of the bags to the filling spouts, a known packaging machine for filling open-mouth bags having four filling spouts is rotated indexed by 90 degrees and then stopped. When the system stops, the open-mouth bag is appended to the filling spout from beneath while the filling process is already started for the next filling spout in sequence. The indexed operation of such a rotary packaging machine attains an increased filling rate. While an open-mouth bag is being appended to the first filling spout, the filling process may take place at a second and a third filling spout while vibrating devices act simultaneously on the open-mouth bags intended for filling to lower the product level and attain compacting.

Vibrating devices are routinely used in filling fine-grain products into open-mouth bags to lower the product level as far as possible. In this way the bag length required for a specific quantity of product can be reduced which may considerably reduce the costs for the open-mouth bags used since a reduced quantity of tubular sheet is required for manufacturing an open-mouth bag. In the case of continuously operating such a packaging machine for filling open-mouth bags, savings of expenses may be considerable if the bag length can be lessened by as little as one centimeter.

Another argument in favor of employing vibrating devices is that the open-mouth bags filled with the product are tightly filled after closing and are thus much more attractive in appearance than bags still containing a high volume of air and showing large overhangs of sheet at their ends.

It is therefore the object of the present invention to provide a packaging machine for filling open-mouth bags which—even when bagging fine-grain bulk goods—allows high throughput.

This object is solved by a packaging machine having the features of claim 1 and by a method having the features of the independent method claim. Preferred specific embodiments are the subjects of the respective subclaims. Further advantages and features of the present invention can be taken from the general description and the description of the exemplary embodiment.

The packaging machine according to the invention is configured as a packaging machine that is in particular rotating continuously and serves for filling open-mouth bags. The rotary packaging machine comprises multiple filling units distributed over the circumference and rotating along, each having one filling spout with a filling opening to which the open-mouth bags can be appended by way of a motion oriented upwardly relative to the filling spout. A handling unit configured as a take-over device is provided for taking over the filled open-mouth bags from the filling units. The take-over device comprises at least one gripping arm with a gripping unit provided thereat. The gripping arm is rotatably disposed at the take-over device and the gripping unit is in particular pivotally disposed at the gripping arm for performing relative to the gripping arm a pivoting motion that is superimposed on the rotation of the gripping arms.

The rotary packaging machine according to the invention has many advantages. A considerable advantage of the packaging machine according to the invention consists in that the take-over device enables continuous, rotating operation of the packaging machine.

Indexed operation is not required since the rotation of the gripping arm of the take-over device allows take-over of the filled, open-mouth bag during the continuous rotary motion of the rotary packaging machine. A pivotal take-up of the gripping unit enables an extended transition phase so as to allow an increased rate of rotation of the packaging machine. This allows to achieve increased performance. The gripping unit is pivotally disposed at the gripping arm for performing a pivoting motion relative to the gripping arm.

In particular is the gripping unit pivoted so as to enable an extended transition phase.

Preferably the packaging machine rotates at a constant rate of rotation and in particular is the rate of rotation virtually constant over at least one full rotation. It is likewise possible to operate the packaging machine at a rate of rotation that is variable over the circumference. A constant rate of rotation is preferred though since it increases throughput. Moreover the rotating portion of the packaging machine does not require continual decelerating and accelerating so as to allow energy saving.

It is possible for the open-mouth bag to be placed on the filling spout from beneath. In this motion the filling spout may remain stationary. The open-mouth bag is placed onto the filling spout by way of an upwardly motion.

Or else it is possible for the filling spout to be inserted into the open-mouth bag from above. In this motion the open-mouth bag may remain stationary and the filling spout may be moved. On the whole this will result in an upwardly motion of the open-mouth bag relative to the filling spout even if in this case the filling spout is moved downwardly.

In the alternative, simultaneous motions of the filling spout and the open-mouth bag are possible. In all the cases the bag performs a relative motion with respect to the filling spout which motion is at least in part directed upwardly relative to the filling spout.

A considerable advantage of the rotary packaging machine according to the invention also consists in that multiple filling units having one or two filling spouts each can be provided which are filled continuously or discontinuously and which during rotation of the packaging machine have sufficient time for deaerating the bagged product or for lowering the product level so that at discharge or at the latest at closing the open-mouth bags, the open-mouth bags are tightly filled, show an optically attractive appearance while at the same time being economical in plastic sheet consumption.

In all the cases it is advantageous for the gripping unit to be pivotally disposed at the gripping arm for performing a superimposed pivoting motion relative to the gripping arm. It has been shown that a gripping unit pivoting along on a specified path in synchrony with the peripheral speed of the filling spouts enables extended parallel travel. The motion of the rotating filling unit with the filling spout provided thereat and the motion of the pivotal gripping arm can be synchronized to one another considerably better so that the gripping unit of the gripping arm is aligned in parallel to the open-mouth bag disposed at the filling unit for a considerably longer time. Thus the time period in which the grippers still hold the open-mouth bag at the filling unit in a defined position, is considerably extended. This allows the gripping unit on the rotating gripping arm to grip the upper bag walls of the open-mouth bag intended for takeup. Only thereafter are the grippers at the filling unit released so that a precisely defined positioning of the open-mouth bag can always be ensured. This allows to realize the shortest possible bag lengths which reduces expenses for the sheet material used and additionally provides an attractive bag appearance since unnecessary bag material overhangs can be avoided.

It is preferred for the take-over device to comprise at least two gripping arms at each of which at least one gripping unit is pivotally provided. In all the configurations the take-over device is provided to take over the filled open-mouth bag from the filling unit and to hand it over to a closing device or a conveyor belt.

In all the configurations it is particularly preferred for the gripping arm of the take-over device to rotate in a direction opposite that of the packaging machine. The rotating filling spouts and the take-over device are positioned relative to one another so that the rotary circles are in tangential contact with, or slightly overlapping, one another so as to enable take-over of a filled open-mouth bag from a filling unit in a precisely defined angular position. A take over of the filled open-mouth bags preferably only takes place when the gripping unit of the gripping arm seizes the upper bag wall of the filled bag. Thus it is for example possible for the gripping unit to not seize the open bag positioned at the filling unit for example if the filling process is not yet completed. This configuration allows the open-mouth bags to continue rotating for another round before they are discharged from the packaging machine and conveyed off by the take-over device. Generally it is also possible to have the bags always remain at the filling spouts for two or more rounds before they are discharged and conveyed off by the take-over device.

The rotary configuration allows to provide a plurality of filling spouts to thus enable a high filling rate since a considerable time period is provided for each individual open-mouth bag for reducing the product level. In particular in the case of fine-grain and dusty products such as construction materials and in particular cement the filling rate can be considerably increased. Preferably at least one compactor is provided. The compactor may be configured as a vibrating device, comprising a vibrating plate and/or a poker vibrator and/or a vacuum lance or the like.

While conventional packaging machines can, by way of indexed, rotary operation, bag up to approximately 1000 open-mouth bags per hour, the rotary packaging machine according to the invention can clearly increase the number of filled open-mouth bags per hour, allowing 2000 filled open-mouth bags per hour and even 2500 filled open-mouth bags per hour and still more.

Particularly preferably the gripping unit comprises at least two grippers for seizing an open-mouth bag. It is also possible and preferred to employ three or four grippers to ensure defined positioning at all times. Preferably at least two grippers are disposed approximately symmetrically to the pivot axis of the gripping unit. Due to the fact that the gripping unit is provided pivotally at the gripping arm, the gripper disposed on the one side of the pivot axis travels at an increased peripheral speed at a particular time, while the gripper disposed on the opposite side of the pivot axis travels at a reduced peripheral speed. The different peripheral speeds of the grippers of the gripping unit ensure that take-over of the filled open-mouth bag can take place over a larger angular range and thus during a longer time period than with the gripping unit fixedly mounted at the gripping arm.

In all the configurations it is preferred for the rotary packaging machine to be configured as a continuously rotating packaging machine. Preferably the take-over device comprises at least one drive for rotating the gripping arm. Preferably, a peripheral speed or rotating speed of the gripping arm is matched to a peripheral speed of the filling spouts. In particular does the peripheral speed of the gripping arm correspond to the peripheral speed of the filling spout at least at the time of take over. Also in this case it is possible for the gripping arm to rotate at a continuously variable rotational speed. It is particularly preferred though for the peripheral speed of the gripping arm to be approximately constant and to at least substantially correspond to the peripheral speed of the filling spout. It is thus ensured that the open-mouth bag maintains its constant traveling speed substantially during the entire process. The open-mouth bag is discharged from the filling unit that rotates at a specific peripheral speed by means of the gripping arm which preferably travels at the same peripheral speed. Finally the open-mouth bag is handed over to a processing device such as a closing unit or a discharging belt or the like having the same speed so that no acceleration in the direction of motion is required. In this way the forces acting on the bag are kept relatively low.

In preferred embodiments the drive for rotating the gripping arm also serves to pivot the gripping unit provided thereat. The number of drives is thus kept low which reduces complexity and susceptibility to failure. Moreover, forced synchronization is achieved. Or else it is possible to provide a separate drive for rotating the gripping unit. Then the drives for rotating the gripping arm and for pivoting the gripping unit are operated in synchrony or are synchronized at regular intervals to ensure the sequence of motions required.

Preferably the rotational speed of the driving crank of the gripping unit is a multiple of the rotational speed of the gripping arm. Particularly preferably the rotational speed of the driving crank of the gripping unit is twice the rotational speed of the gripping arm. In preferred specific embodiments it is also possible for the rotational speed of the driving crank of the gripping unit to be an integer multiple of double the rotational speed of the gripping arm.

A rotational speed of the driving crank of the gripping unit twice that of the rotational speed of the gripping arm ensures that the gripping unit is oriented on the circumference for example perpendicular to the orientation of the gripping arm in two positions.

This is to achieve that in two peripheral positions the gripping unit is oriented tangentially to the orientation of the gripping arm so that the gripping unit is also oriented tangentially to the open-mouth bag attached to the filling unit and intended for takeover.

For example if three gripping arms are provided then the pivoting speed of the gripping unit can be matched accordingly.

In all the configurations it is preferred for the gripping arm and the gripping unit provided thereat to be configured to firstly rotate or pivot in opposite directions during bag handover. This configuration results in that the gripper of the gripping unit following in the rotational direction of the gripping arm reduces its center distance from the center of rotation of the gripping arm until the gripping unit is oriented transverse to the gripping arm. Thereafter the respective gripping unit is pivoted back in the reverse direction so that the time period of parallel positions with the bag intended for takeover is extended. The gripping unit thus performs a pendulum motion relative to the gripping arm. The pendulum motion is dimensioned so as to equalize the different rotation circle diameters of the packaging machine and the gripping arms. It may be dimensioned correspondingly larger or smaller in differently configured systems.

During the bag handover the pivoting motion or pendulum motion of the gripping unit causes a nearly parallel arrangement of the gripping unit and the upper bag wall. After the handover the gripping unit swings back in the other direction, i.e. in the same sense of rotation with the gripping arm, to then once again swing in the other sense of rotation for handover to the processing device. Handover to the processing device will again take place in an extended angular range in which the open-mouth bag extends substantially in parallel to the processing device so as to enable easy handover to a linear guide.

In all the configurations it is preferred for a holding device to be disposed beneath the gripping unit traveling in synchrony with the grippers of the gripping unit. The holding device ensures that the bag intended for takeover is not only gripped by its top bag wall but is also supported in a lower, lateral region so as to provide defined guiding of the taken-over open-mouth bag both at its top edge and also in a lower region. Thus the loads acting on the top bag wall and on the open-mouth bag are on the whole clearly reduced as the open-mouth bag is handed over from the rotary motion at the filling spout to the rotary motion at the gripping arm having a clearly reduced rotary radius.

The holding device is preferably fixedly connected with the gripping unit. Grippers provided at the holding device are operated in synchrony or substantially in synchrony with the grippers of the gripping unit.

Preferably the gripping unit comprises at least one tensioning unit for flattening and tensioning a top bag wall of the open-mouth bag. For filling open-mouth bags, filling spouts having large cross-sections are used. After discharge of the open-mouth bag from the filling spout the top bag wall should be stretched between its two ends for the top bag wall adapted to the filling spout cross-section to flatten out once again so as to allow wrinkle-free closing. Wrinkle-free closing is important for open-mouth bags of plastic sheet materials to ensure the required seal tightness and stressability of the closed open-mouth bags.

In preferred configurations the take-over device is intended to hand over the filled open-mouth bags to a processing device. The processing device may comprise a linear guide and/or a closing device. It is possible and preferred for a take-over device to hand over the filled open-mouth bags to a closing device.

Preferably at least one support unit is provided which supports the open-mouth bag from beneath during transport by the take-over device. This is to ease the loads acting on the top bag wall and the gripping arm.

It is preferred for the support unit to comprise at least one compactor to enable further lowering of the product level even during transport of the open-mouth bag by the take-over device. It is possible for the support unit to comprise a gliding plate and/or a belt and/or a roller guideway or the like. In all the configurations it is preferred to provide a bag former that manufactures the bags required for example from a tubular plastic sheet.

Preferably a handling unit configured as an appending device is provided intended for appending the open-mouth bags intended for filling. It is likewise conceivable to use two appending devices for one rotary packaging machine. The appending device serves to append the open-mouth bags intended for filling and to open the bags preferably prior to appending so as to provide an opening corresponding to the filling spout cross section. For appending, an open-mouth bag is appended from beneath to the filling spout with the filling opening in particular provided at the bottom.

Another rotary packaging machine according to the invention for filling open-mouth bags is equipped with multiple filling units distributed over the circumference and rotating along, each comprising one filling spout having one filling opening. The open-mouth bags are appended by way of a motion oriented upwardly relative to the filling spout. At least one handling unit configured as a take-over device is provided for handing over the open-mouth bags intended for filling to the filling units which comprises at least one gripping arm with a gripping unit provided thereat. The gripping arm is rotatingly disposed at the take-over device and the gripping unit is in particular pivotally disposed at the gripping arm to perform a pivoting motion relative to the gripping arm.

According to the invention the handling unit can take over open-mouth bags from the filling units after filling. It is also possible for a handling unit to hand over empty bags to the continuously rotating packaging machine.

The method according to the invention serves for filling open-mouth bags by means of a rotary packaging machine which comprises multiple filling units distributed over the circumference and rotating along continuously. The open-mouth bags are appended to the filling opening of the filling spouts from beneath during rotation. A take-over device is provided comprising a rotary gripping arm with a gripping unit. The gripping unit is in particular pivotally disposed at the gripping arm for performing a pivoting motion relative to the gripping arm. During rotation the gripping unit takes over the open-mouth bags from the filling unit.

The method according to the invention has many advantages since it allows high filling rates and safe handling of the open-mouth bags.

Preferably the gripping unit is configured pivotable relative to the gripping arm to enable an extended handover phase. This allows to use a longer distance along the periphery of the packaging machine for handover. At the same time the handover distance is comparatively small relative to the entire periphery so that a large number of filling spouts can be disposed over the circumference. The angular range available for handover is, depending on the number of filling spouts, for example between 15° and 45°.

In all the configurations a filled open-mouth bag is preferably discharged from the filling spout and held in a defined position before the take-over device takes over the open-mouth bag.

On the whole the invention provides a rotary packaging machine and a method for filling open-mouth bags allowing high filling rates of bags filled as defined. The quantity of bag sheets required is low so that filling the bags can be precisely defined.

Further advantages and features of the present invention can be taken from the exemplary embodiment which will be described below with reference to the enclosed figures.

Figure 2:
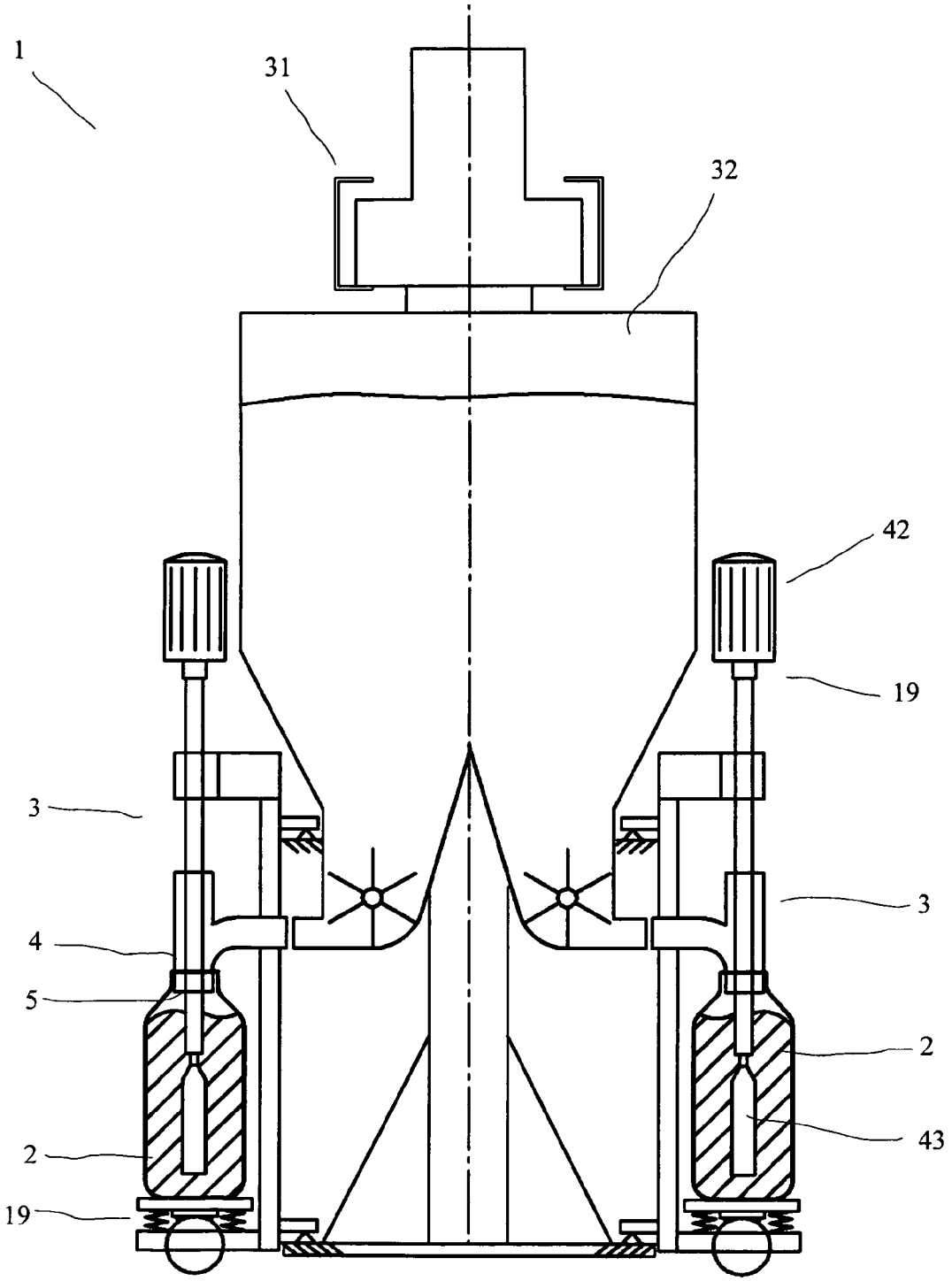
Figure 3:
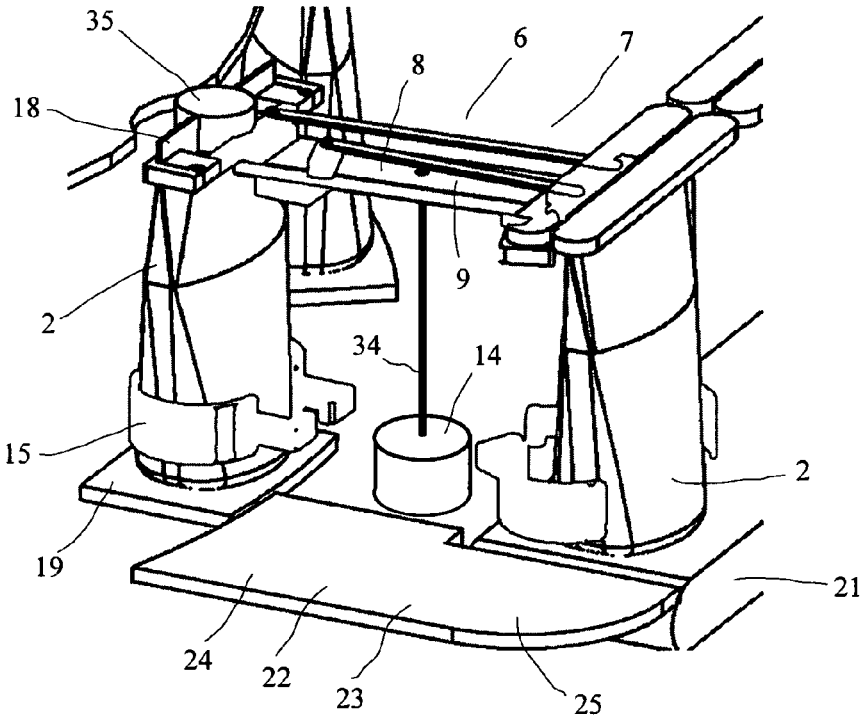
Figure 4:
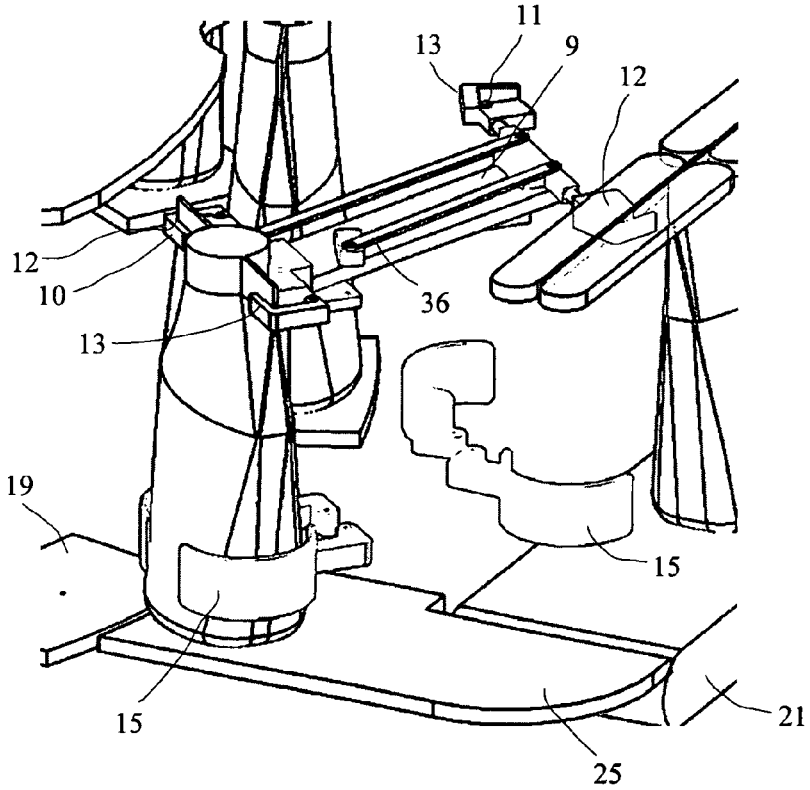
Figure 5:
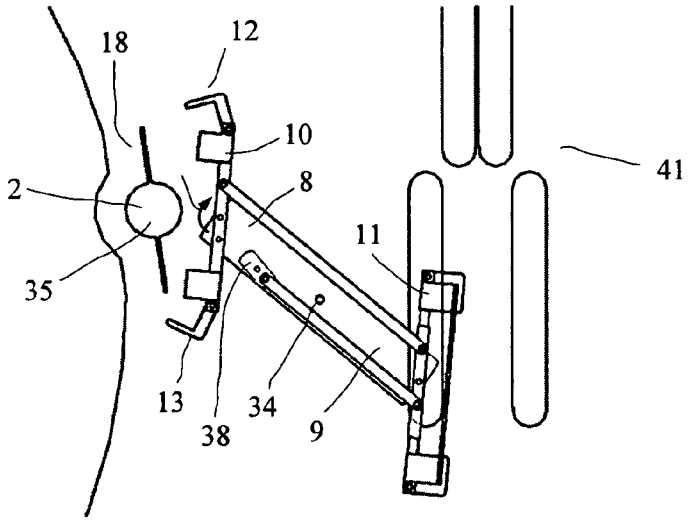
Figure 6:
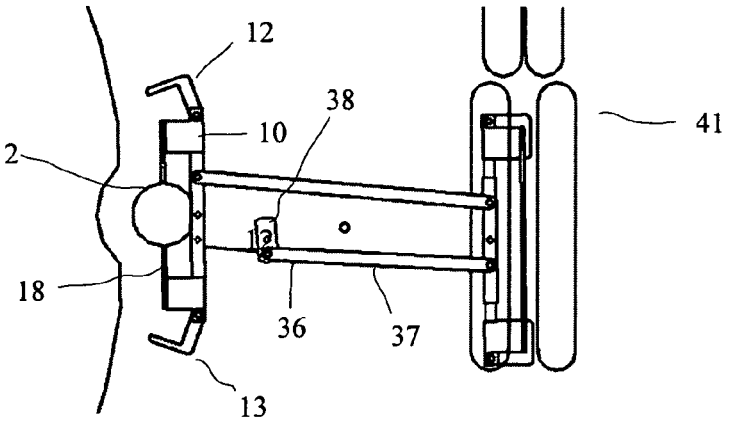
Figure 7:
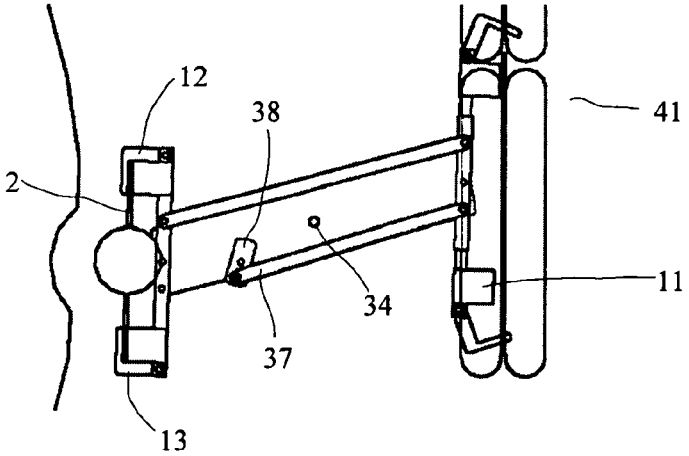
Figure 8:
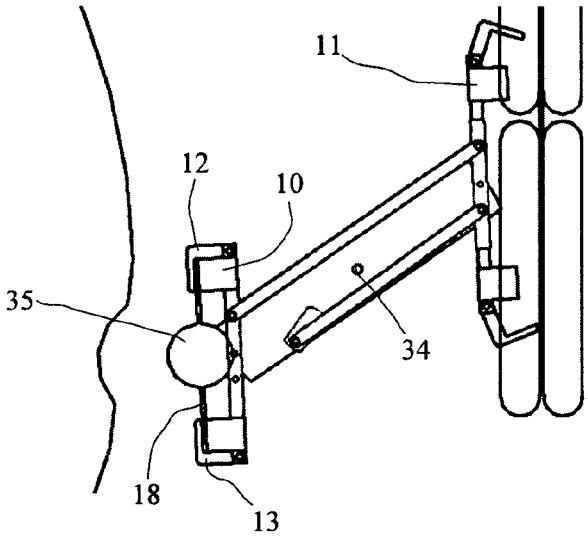
Figure 9:
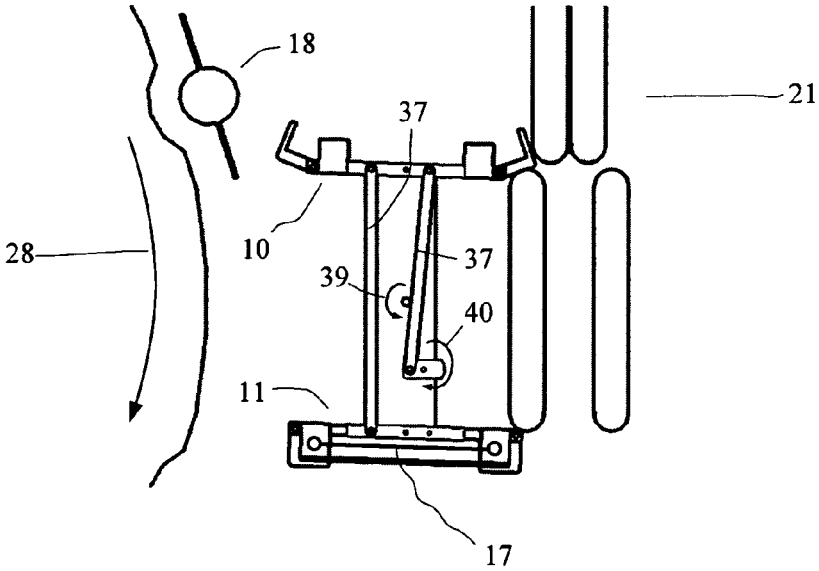
Figure 10:
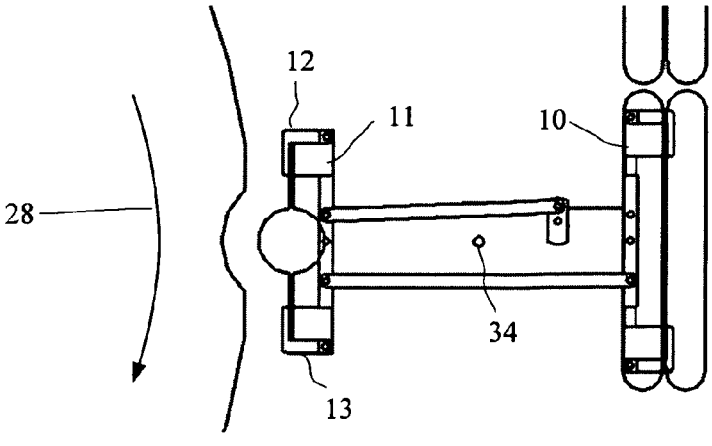

The drawings show in:

FIG. 1 a schematic top view of a packaging machine according to the invention;

FIG. 2 a side view of the packaging machine according to FIG. 1;

FIG. 3 a schematic, enlarged illustration of the take-over device of the packaging machine according to FIG. 1;

FIG. 4 the take-over device of FIG. 3 in another position;

FIG. 5 a simplistic top view of the packaging machine and the take-over device in a first position;

FIG. 6 a view according to FIG. 5 in a second position;

FIG. 7 a simplistic top view according to FIG. 5 in a third position;

FIG. 8 a simplistic top view according to FIG. 5 in a fourth position;

FIG. 9 a simplistic top view according to FIG. 5 in a fifth position;

FIG. 10 a simplistic top view according to FIG. 5 in a sixth position;

With reference to the enclosed figures an exemplary embodiment of a rotary packaging machine 1 according to the invention will be discussed below, which is illustrated in FIG. 1 in a schematic top view. The rotary packaging machine 1 serves for filling open-mouth bags 2 (see FIG. 3) and is provided with multiple filling units 3 each of which is presently equipped with a filling spout 4. Between about two and sixteen filling units 3 can be disposed at the presently illustrated packaging machine 1. Basically it is also possible to install a still larger number of filling units at a rotary packaging machine 1.

The rotary packaging machine 1 is operated rotating continuously so that the filling units 3 rotate about a center axis at substantially constant speed. The material intended for bagging is fed via an inlet hopper 28 and a silo 32 to the individual filling spouts 4 of the filling units 3.

The filling spouts 4 for filling the open-mouth bags 2 are presently aligned vertically so that the filling opening 5 is directed perpendicularly downwardly. Or else it is possible for the or at least one filling opening to be aligned at an inclination to the vertical. For example an angle of five degrees, ten degrees, or else twenty degrees to the vertical may be provided. Open-mouth bags 2 are appended from beneath to the bottom filling opening 5 of the filling spouts 4.

To this end an open-mouth bag 2 is gripped and the upper bag wall 18 is opened so as to form the upper bag opening 35. Preferably suckers and/or grippers are used to form a bag opening 35 in the open-mouth bag 2 matching the cross-section shape of the filling spout 4 and to hold the open-mouth bag 2 by its top bag wall 18 in a defined position until the open-mouth bag 2 has been pushed onto the filling spout 4 where it is held in a defined position by grippers (not shown).

The open-mouth bags 2 are placed by means of an appending device 27 downstream of a bag former 26. The bag former 26 manufactures the individual open-mouth bags 2 from a tubular sheet during the continuous operation. Desired lengths are cut off the tubular sheet and the bottom seams are inserted into the open-mouth bags 2. Or else, pre-formed or pre-fabricated open-mouth bags 2 may be used.

During rotation, which in this instance is counter-clockwise, the open-mouth bags are filled. Simultaneously the compactors 19 which are provided at each filling unit 3 and which are height-adjustable, attain compacting of the product so that the product level is reduced. Due to the product being compacted the open-mouth bags 2 required are on the whole shorter and a tightly filled open-mouth bag 2 is formed that does not only use less sheet material but also offers an optically attractive appearance.

The sheet used for forming the open-mouth bags 2 results in a relatively low inherent stiffness—unlike paper bags—of the open-mouth bags 2 so that precisely defined guiding of the open-mouth bags 2 should be ensured at all times to enable comparatively short bag lengths and short bag material overhangs.

When the open-mouth bag 2 is filled with the intended quantity and reaches the angular position of the discharge device 6 then the open-mouth bag 2 is discharged from the filling spout 4 while it is still supported from beneath by the compactor 19. In a suitable angular position the take-over device 6 with the gripping arms 8 and 9 rotating around a shared center 34 takes over the open-mouth bag 2 and hands it over to the linear guide 21 having a closing device 20 for closing the open top edges of the open-mouth bags 2. Due to the open-mouth bag 2 being at all times held and guided in a defined position, a defined closing of the open-mouth bags 2 can likewise be ensured.

A protective fence 33 may be provided to prevent access to the danger zone.

The rotary packaging machine 1 is preferably suspended from framework 30 with poles 31 supporting the rotary packaging machine. In the upper range of the rotary portion a silo 32 may be provided for intermediate product storage.

FIG. 3 shows a simplistic view of the handling unit 7 configured as a take-over device 6 in a position while the take-over device 6 is taking over an open-mouth bag 2 from the packaging machine 1 by means of the gripping unit 10 at the gripping arm 8. For the sake of clarity not all the components are illustrated.

The open-mouth bag 2 is supported from beneath by the compactor 19 of the filling unit 3. In the position illustrated the gripping unit 10 of the gripping arm 8 has gripped the top bag wall 18 by means of the grippers 12 and 13. Simultaneously the holding device 15 surrounds a bottom portion of the filled open-mouth bag 2. The bag opening 35 by which the open-mouth bag 2 has been appended at the filling spout 4 is still opened virtually unchanged. By way of the open-mouth bag 2 swiveling away from the packaging machine 1 the take-over device 6 arrives in the position shown in FIG. 4 in which the open-mouth bag 2 is swiveled in the direction toward the linear guide 21 supported from beneath by the gliding plate 25. The grippers 12 and 13 of the gripping unit 10 hold the top bag wall 18 in a defined position.

In the illustration of FIG. 3 the gripping arm 9 hands over the open-mouth bag 2 to the linear guide 21. In the illustration of FIG. 4 the gripping arm 9 with the gripping unit 11 has released the open-mouth bag 2 handed over to the linear guide 21 and swivels in the direction of the rotating filling units 3 to then take over the open-mouth bag 2 next coming into the discharge position.

The take-over device 6 is rotatingly driven by a drive 14 that drives the take-over device 6 rotatingly about a rotation axis 34.

In this exemplary embodiment the drive 14 does not only drive the rotational motion of the gripping arms 8 and 9 but, via a fixed transmission ratio, also the pivoting motion of the gripping units 10 and 11. A fixed transmission ratio is used so that the gripping units 10 and 11 swivel at double the frequency of the rotation frequency of the gripping arms 8 and 9.

In this way a parallel orientation of the gripping units 10 and 11 is ensured relative to an open-mouth bag 2 disposed at a filling unit 3 in the discharge position, in precisely two positions. An open-mouth bag 2 is taken over from the filling unit 3 by a gripping unit 10 disposed in parallel while simultaneously a gripping unit 11 disposed in parallel to the linear guide 21 hands over the respective open-mouth bag 2 to the linear guide 21.

During swiveling from the packaging machine 1 to the linear guide 21 the holding device 15 provides secure hold of the filled open-mouth bags 2 in a bottom region. This also contributes to reduce the loads acting on the top bag wall 18. The holding device 15 may be height-adjustable.

With reference to FIGS. 7-10 the function of the take-over device 6 as the handling unit 7 will be described below by way of schematic top views.

The take-over device 6 illustrated in FIG. 5 in a first position, with opened grippers 12 and 13 of the gripping unit 10, approaches the rotary packaging machine 1 and the open-mouth bag 2 disposed at a filling spout 4.

As a comparison of FIGS. 5, 6, 7 and 8 shows, the swiveling of the gripping unit 10 by way of the crankshaft drive 36 with the coupling rod 37 and the crank 38 results in the gripping unit 10 remaining over a rather broad angular range oriented in parallel, or substantially in parallel, to the longitudinal extension of the top bag wall 18. In FIG. 5 the side of the gripper 12 of the gripping unit 10 advances past the gripping arm 8 while subsequently the effective swiveling speed is reduced so that in the illustration of FIG. 8 the angle between the gripping arm 8 and the gripping unit 10 is acute on the side of the gripper 12.

The crankshaft drive 36, via the crank 38 and the coupling rod 37, causes the gripping units 10 and 11 to swivel so as to result in an advantageous overlapping in the handover regions at the packaging machine 1 and the linear guide 21.

The grippers 12 and 13 firstly grip the top bag wall 18 of an open-mouth bag 2 before the respective grippers at the filling unit 3 release the open-mouth bag 2. Thereafter by means of the gripping unit 10 and the holding device 15 the open-mouth bag 2 is pulled off the compactor 19 configured in particular as a vibrating device (see FIG. 4) and being supported, taken by the support unit 22 to the linear guide 21. The support unit 22 may be configured as a roller guideway 23, compactor 24, or a gliding plate 25 or the like.

At the linear guide 21 there ensues in turn a comparatively large angular segment with an overlapping region within which the open-mouth bag 2 is handed over to the linear guide 21.

During the swiveling motion from the filling unit 3 to the linear guide 21, a tensioning unit 17 is activated by way of which the distance between the grippers 12 and 13 extends and thus the top edge of the bag wall 18 is tensioned. This allows a wrinkle-free closing of the top bag wall 8 of the open-mouth bag 2.

In FIG. 9 the direction of rotation 28 of the packaging machine 1 is shown. The direction of rotation 39 of the gripping arms 8 and 9 is reversed.

On the whole an advantageous continuously rotating packaging machine 1 for filling open-mouth bags is provided which allows high filling rates. Simultaneously the complexity can be reduced since overall only one single closing device is required instead of providing each filling spout with its own. Or else, e.g. two closing devices may be used. The filled open-mouth bags 2 can be taken over from the take-over device 6 and fed to a closing device. Thus, a high filling rate is provided while one closing device only is required for a number of filling spouts. By means of opposite rotational motions of the take-over device 6 and the filling units 3, reliable discharge and handover of the filled bags is enabled in particular in conjunction with the swiveling gripping units.

List of reference numerals:

| | |
|---|---|
| 1 | Rotary packaging machine |
| 2 | open-mouth bag |
| 3 | filling unit |
| 4 | filling spout |
| 5 | filling opening |
| 6 | take-over device |
| 7 | handling unit |
| 8 | gripping arm |
| 9 | gripping arm |
| 10 | gripping unit |
| 11 | gripping unit |
| 12 | gripper |
| 13 | gripper |
| 14 | drive |
| 15 | holding device |
| 17 | tensioning unit |
| 18 | bag wall |
| 19 | compactor |
| 20 | closing device |
| 21 | linear guide |
| 22 | support unit |
| 23 | roller guideway |
| 24 | compactor |
| 25 | gliding plate |
| 26 | bag former |
| 27 | appending device |
| 28 | direction of rotation |
| 29 | inlet hopper |
| 30 | framework |
| 31 | pole |
| 32 | silo |
| 33 | protective fence |
| 34 | rotation axis |
| 35 | bag opening |
| 36 | crankshaft drive |
| 37 | coupling rod |
| 38 | crank |
| 39 | direction of rotation |
| 40 | direction of rotation |
| 41 | processing device |
| 42 | drive |
| 43 | poker vibrator |

The invention claimed is:

1. A rotary packaging machine (1) for filling open-mouth bags (2) having multiple filling units (3) disposed over the circumference and rotating along each of which having a filling spout (4) with a filling opening (5) to which by way of a motion oriented upwardly relative to the filling spout the open-mouth bags (2) can be appended, characterized in that a handling unit (7) configured as a take-over device (6) for taking over the filled open-mouth bags (2) from the filling units (3) is provided, comprising at least one gripping arm (8, 9) with a gripping unit (10, 11) provided thereat wherein the gripping arm (8, 9) is rotatably disposed at the take-over device (6) and wherein the gripping unit (10, 11) is pivotally disposed at the gripping arm (8, 9) to perform relative to the gripping arm (8, 9) a pivoting motion that is superimposed on the rotation of the gripping arms, wherein the gripping unit (10, 11) comprises at least two grippers (12, 13) to seize an open-mouth bag (2).

2. The rotary packaging machine (1) according to claim 1 which is configured to rotate continuously and wherein the take-over device (6) comprises a drive (14) for rotating the gripping arm (8, 9) wherein a peripheral speed of the gripping arm (8, 9) is matched to a peripheral speed of the filling spouts (4).

3. The rotary packaging machine (1) according to claim 2 wherein the drive (14) also serves for swiveling the gripping unit (10, 11) and/or wherein the rotational speed of a crank (38) of the gripping unit (10, 11) is a multiple of the rotational speed of the gripping arm (8, 9).

4. The rotary packaging machine (1) according to claim 1 wherein the gripping arm and the gripping unit provided thereat are configured to pivot in opposite directions during bag handover.

5. The rotary packaging machine (1) according to claim 1 wherein a holding device (15) is disposed beneath the gripping unit (10, 11) and is guided in synchrony therewith.

6. The rotary packaging machine (1) according to claim 1 wherein the gripping unit (10, 11) comprises a tensioning unit (16) by means of which a top bag wall (18) can be flattened and tensioned.

7. The rotary packaging machine (1) according to claim 1 wherein the filling unit (3) comprises at least one compactor (19) provided beneath the filling spout (4) and which is in particular disposed to be height-adjustable.

8. The rotary packaging machine (1) according to claim 1 wherein the take-over device (6) is provided to hand over the filled open-mouth bags (2) to a processing device (41).

9. The rotary packaging machine (1) according to claim 1 wherein a support unit (22) is provided supporting the open-mouth bag (2) from beneath during transport by the take-over device (6).

10. The rotary packaging machine (1) according to claim 9 wherein the support unit (6) comprises at least one compactor (24).

11. The rotary packaging machine (1) according to claim 1 wherein at least one bag former (26) is provided.

12. A method for filling open-mouth bags (2) by means of a continuously rotating packaging machine (1) which comprises multiple filling units (3) disposed over the circumference and rotating along continuously, the method comprising appending each of the open-mouth bags (2) to a filling opening (5) of a filling spout (4) from beneath during rotation, wherein a take-over device (6) is provided comprising a rotating gripping arm (8, 9) including a gripping unit (10, 11), the method further comprising a step of the gripping arm (8, 9) taking over one of the open-mouth bags (2) from the filling unit (3) during rotation by means of the gripping unit (10, 11) of said gripping arm (8, 9), and a step of swivelling the gripping unit (10, 11) relative to the gripping arm (8, 9) to enable an extended handover phase.

13. The method according to claim 12 wherein comprising discharging one of said open-mouth bags from its filling spout and holding said open-mouth bag in a defined position prior to it being taken over by the take-over device.

* * * * *